US008628170B2

(12) United States Patent
Takeda et al.

(10) Patent No.: US 8,628,170 B2
(45) Date of Patent: Jan. 14, 2014

(54) RECORDING APPARATUS

(75) Inventors: Kengo Takeda, Inazawa (JP); Shigeki Kato, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 258 days.

(21) Appl. No.: 13/072,751

(22) Filed: Mar. 27, 2011

(65) Prior Publication Data

US 2011/0292101 A1 Dec. 1, 2011

(30) Foreign Application Priority Data

May 31, 2010 (JP) ..... 2010-125311

(51) Int. Cl.
*B41J 2/165* (2006.01)

(52) U.S. Cl.
USPC ..... 347/33; 347/5

(58) Field of Classification Search
USPC ..... 347/33, 5, 16
See application file for complete search history.

(56) References Cited

U.S. PATENT DOCUMENTS 5,225,853 A * 7/1993 Kobayashi et al. ..... 347/33
5,531,436 A 7/1996 Ohyama
6,106,090 A * 8/2000 Uchida et al. ..... 347/8
6,290,351 B1 * 9/2001 Merz ..... 347/104
8,109,595 B2 * 2/2012 Tanaka et al. ..... 347/22
2009/0028596 A1 * 1/2009 Okumura et al. ..... 399/71

FOREIGN PATENT DOCUMENTS

JP H07-137877 A 5/1995
JP 2004161454 A * 6/2004
JP 2006-206279 A 8/2006
JP 2007131372 A * 5/2007
JP 2009-139583 A 6/2009

* cited by examiner

*Primary Examiner* — Julian Huffman
*Assistant Examiner* — Sharon A Polk
(74) *Attorney, Agent, or Firm* — Baker Botts L.L.P.

(57) ABSTRACT

A recording apparatus, including: a recording head; a conveying member for conveying a recording medium in a conveyance direction; a wiper whose distal end is to come into contact with and separate away from the surface; a wiper driving mechanism for driving the wiper to conduct a wiping operation in which the distal end is brought into contact with the surface and the wiper is moved relative to the surface in an intersecting direction that intersects the conveyance direction for wiping the surface; a retainer for giving, to the conveying member, a retaining force for preventing a movement of the conveying member in the intersecting direction; and a controller for controlling the retainer to give the retaining force to the conveying member and for controlling the driving mechanism to conduct the wiping operation, in a state in which the movement of the conveying member in the conveyance direction is halted.

8 Claims, 9 Drawing Sheets

RECORDING APPARATUS

CROSS REFERENCE TO RELATED APPLICATION

The present application claims priority from Japanese Patent Application No. 2010-125311, which was filed on May 31, 2010, the disclosure of which is herein incorporated by reference in its entirety.

BACKGROUND OF THE INVENTION

1. Field of the Invention

The present invention relates to a recording apparatus configured to record an image on a recording medium.

2. Discussion of Related Art

There is known an image forming apparatus including a cleaning blade configured to wipe away ink adhering to a surface of a conveyor belt by moving the cleaning blade in a width direction of the conveyor belt, i.e., in a direction orthogonal to a sheet conveyance direction, while the cleaning blade is held in abutting contact with the surface of the conveyor belt.

SUMMARY OF THE INVENTION

In the image forming apparatus described above, the conveyor belt may be shifted in the moving direction of the cleaning blade due to a frictional force between the conveyor belt and the cleaning blade, when the surface of the conveyor belt is wiped with the cleaning blade. Where the conveyor belt is driven to move in a state in which the conveyor belt is shifted from a nominal position, there may be generated meandering or winding of the conveyor belt, resulting in a reduction of sheet conveyance accuracy. This may lead to a reduction in accuracy with which an image is formed on a sheet.

It is therefore an object of the invention to provide a recording apparatus in which a conveying member is restrained from moving when a surface of the conveying member is wiped.

The above-indicated object of the invention may be achieved according to a principle of the invention, which provides a recording apparatus, comprising:

a recording head configured to record an image by ejecting a liquid to a recording medium;

a conveying member disposed such that a surface thereof is opposed to the recording head and configured to convey the recording medium in a conveyance direction by moving in the conveyance direction while holding the recording medium on the surface;

a wiper disposed such that a distal end thereof is to come into contact with and separate away from the surface;

a wiper driving mechanism configured to drive the wiper to conduct a wiping operation in which the distal end of the wiper is brought into contact with the surface and the wiper is moved relative to the surface in an intersecting direction that intersects the conveyance direction so as to wipe off foreign substances on the surface;

a retainer configured to give, to the conveying member, a retaining force for preventing a movement of the conveying member in the intersecting direction; and a controller configured to control the retainer to give the retaining force to the conveying member and to control the wiper driving mechanism to conduct the wiping operation, in a state in which the movement of the conveying member in the conveyance direction is halted.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

There will be hereinafter described a preferred embodiment of the invention with reference to the drawings.

Figure 1:
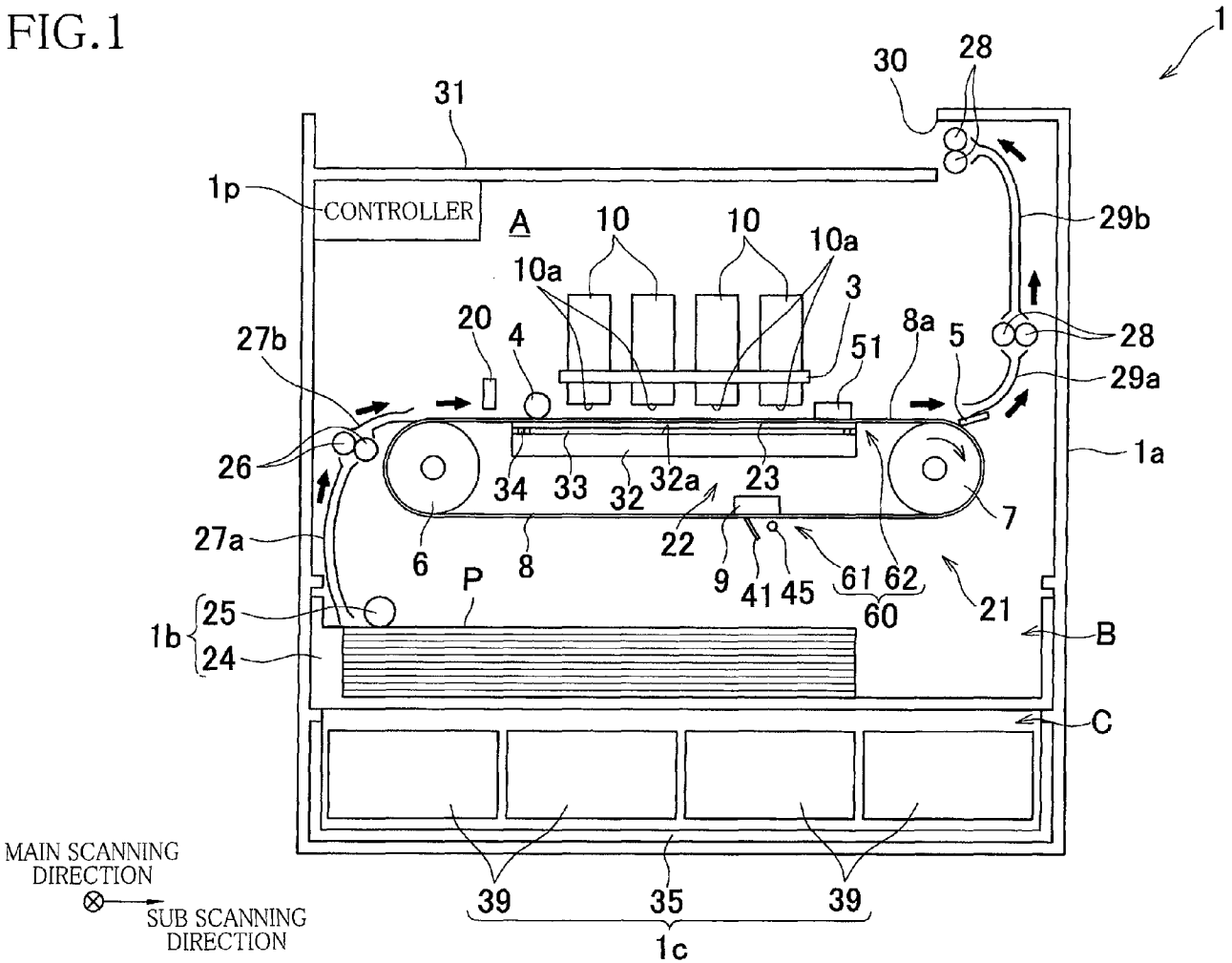
FIG. 1 is a side view schematically showing an overall structure of an ink-jet printer according to one embodiment of the invention.
Figure 2:
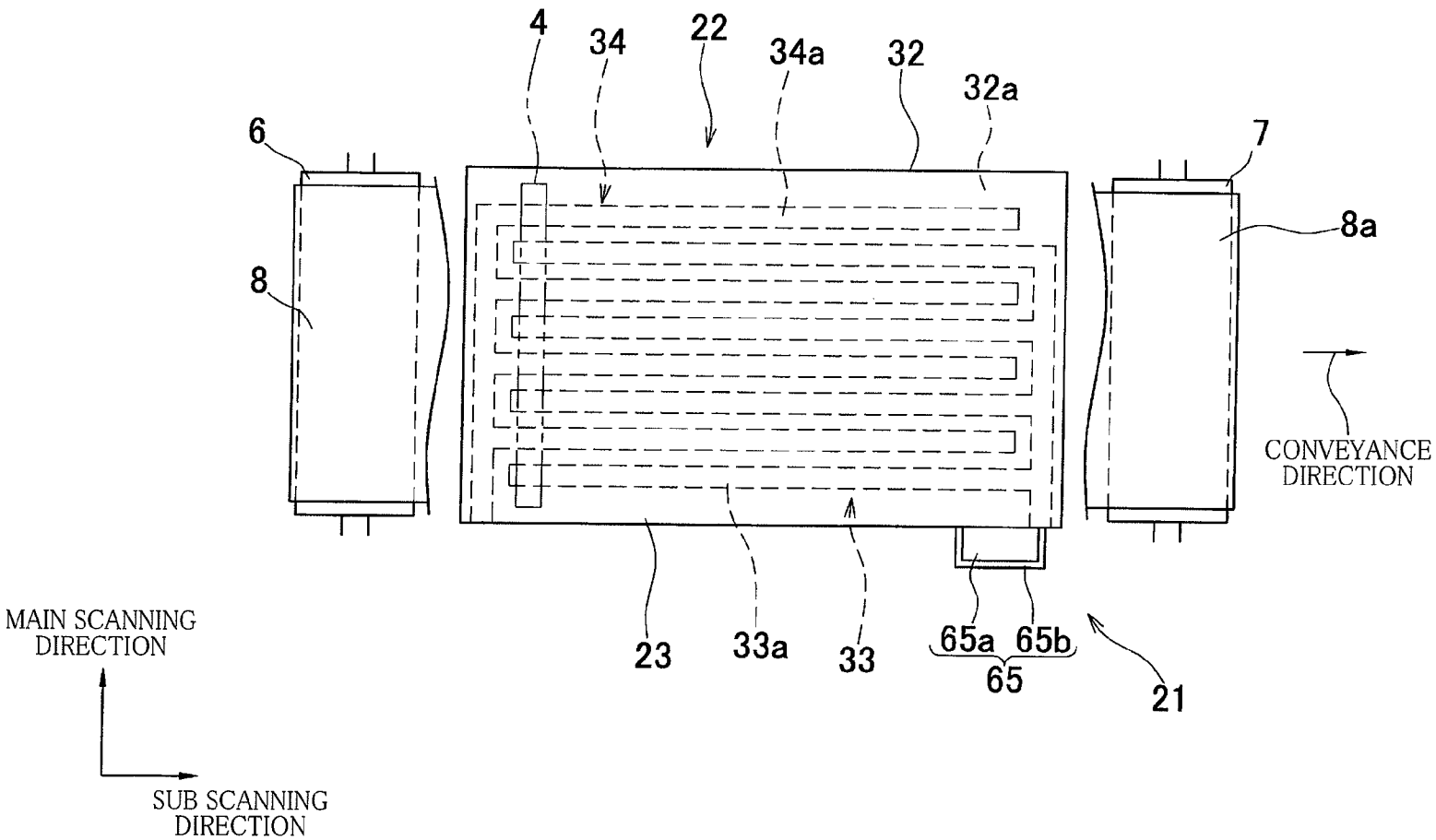
FIG. 2 is a plan view schematically showing a conveyor unit shown in FIG. 1.

Referring first to FIGS. 1 and 2, there will be explained an overall structure of an ink-jet printer 1 according to one embodiment of a recording apparatus of the invention.

As shown in FIG. 1, the printer 1 has a housing 1*a* having a generally parallelepiped shape. On a top plate of the housing 1*a*, there is provided a discharged-sheet receiving portion 31. The housing 1*a* has an inner space which is divided into three spaces A, B, C, arranged in this order from the top of the housing 1*a*. In the spaces A and B, there is formed a sheet conveyance path connected to the discharged-sheet receiving portion 31. In the space C, there are accommodated cartridges 39, each as an ink supply source, from which inks are supplied to respective ink-jet heads 10.

In the space A, there are disposed: the four ink-jet heads 10 for respectively ejecting a magenta ink, a cyan ink, a yellow ink, and a black ink; a conveyor unit 21 for conveying a sheet P as a recording medium in a conveyance direction, i.e., in a direction from the left to the right in FIG. 1; a maintenance unit 60; and a guide unit for guiding the sheet P. In the space A, there is further disposed a controller 1*p* configured to control operations of various portions of the printer 1 for thereby controlling operations of the printer 1 as a whole.

The controller 1*p* controls, on the basis of image data supplied from an external device, a recording operation including a conveyance operation of conveying the sheet P by various portions of the printer 1 and ink ejection operation which is synchronized with the conveyance of the sheet P. On the basis of a wiping command, the controller 1*p* executes maintenance by controlling driving of the conveyor unit 21 and the maintenance unit 60. Here, the maintenance includes a series of operations including a wiping operation for removing foreign substances such as ink and paper dusts on a surface 8*a* of a conveyor belt 8. Details of the maintenance will be later explained with reference to FIG. 8.

The conveyor unit 21 includes: belt rollers 6, 7; the endless conveyor belt 8, as a conveying member, wound around the two rollers 6, 7; a nip roller 4 and a separation plate 5 disposed outside the loop of the conveyor belt 8; and an attraction platen 22 disposed inside the loop of the conveyor belt 8. When the belt roller 7 is rotated, the conveyor belt 8 runs or moves in a direction indicated by bold arrows in FIG. 1. The belt roller 7 is a drive roller and is rotated clockwise in FIG. 1 by a conveyance motor 121 (FIG. 6) driven by the controller 1*p*. The belt roller 6 is a driven roller and is rotated clockwise in FIG. 1 by the movement of the conveyor belt 8. A conveying-member driving mechanism is constituted by a part of the conveyor unit 21 including the conveyance motor 121.

The conveyor belt 8 is formed of polyimide or fluororesin, for instance. The conveyor belt 8 has flexibility and volume resistivity of about $10^8$-$10^{14}$ Ωcm. The conveyor belt 8 may be formed of any other material, provided that the material permits the conveyor belt 8 to have the flexibility and the volume resistivity described above. Here, a sub scanning direction is a direction parallel to the conveyance direction of the sheet P in which the sheet P is conveyed by the conveyor unit 21 while a main scanning direction is a direction parallel to a horizontal plane and orthogonal to the sub scanning direction.

As shown in FIGS. 1 and 2, the attraction platen 22 includes: a plate-like base member 32 formed of an electrically insulating material: two electrodes 33, 34 bonded to an upper surface 32*a* of the base member 32; and a protective film 23 bonded to the upper surface 32*a* so as to cover the entirety of the electrodes 33, 34. The attraction platen 22 is disposed so as to be opposed to the four heads 10 with the conveyor belt 8 interposed therebetween and supports an upper portion of the loop of the conveyor belt 8 from the inside of the loop. The electrode 33 has a plurality of extending portions 33*a* and the electrode 34 has a plurality of extending portions 34*a*. Each of the extending portions 33*a*, 34*a* extends in the sub scanning direction, i.e., the conveyance direction. The extending portions 33*a*, 34*a* are alternately arranged in the main scanning direction, so that the electrodes 33, 34 have a comb-like shape shown in FIG. 2. The electrodes 33, 34 are connected to a power source 36 (FIG. 6) disposed in the housing 1*a*. The power source 36 is controlled by the controller 1*p*. The attraction platen 22 and the power source 36 constitute an attraction portion configured to permit the sheet P to be attracted to the surface 8*a* of the conveyor belt 8.

The protective film 23 is formed of polyimide or fluororesin, for instance, and has volume resistivity of about $10^8$-$10^{14}$ Ωcm. The protective film 23 may be formed of any other material, provided that the material permits the protective film 23 to have the volume resistivity described above.

The nip roller 4 as an electrically conductive member is located at an upstream end of the attraction platen 22 where the nip roller 4 is opposed to the extending portions 33*a*, 34*a* of the electrodes 33, 34. The nip roller 4 is configured to press, onto the surface 8*a* of the conveyor belt 8, the sheet P supplied from the sheet supply unit 1*b*. The nip roller 4 is formed of an electrically conductive material. It is noted that the attraction portion described above and the nip roller 4 constitute a retainer.

In the arrangement described above, under the control of the controller 1*p*, the belt roller 7 is rotated clockwise in FIG. 1, whereby the conveyor belt 8 rotates. In this instance, the belt roller 6 and the nip roller 4 are also rotated by the rotation of the conveyor belt 8. Further, when the sheet P is conveyed by the conveyor belt 8, there are given, under the control of the controller 1*p*, mutually different potentials to the respective two electrodes 33, 34, namely, a positive or negative potential to the electrode 33 and the ground potential to the electrode 34. For instance, the potential of 1 kV is given to the electrode 33 when the sheet P is conveyed by the conveyor belt 8.

When the potentials are thus given to the respective two electrodes 33, 34, the electric current through a portion of the conveyor belt 8 opposed to the nip roller 4 flows as follows because the nip roller 4 is electrically conductive. That is, the electric current flows from the electrode 33 (the extending portions 33*a*) to the nip roller 4 through the protective film 23, the conveyor belt 8, and the sheet P and flows from the nip roller 4 to the electrode 34 (the extending portions 34*a*) through the sheet P, the conveyor belt 8, and the protective film 23, and positive or negative electric charge is generated at a part of the conveyor belt 8 that is opposed to the sheet P while electric charge whose polarity is opposite to that of the above-indicated electric charge is induced on the surface of the sheet P that is opposed to the conveyor belt 8. The electric charge generated on the conveyor belt 8 and the electric charge generated on the sheet P are attracted to each other, whereby there is generated an attraction force by which the sheet P is attracted to the conveyor belt 8.

On the other hand, for the other portion of the conveyor belt 8 that is not opposed to the nip roller 4, the electric current flows from the electrode 33 (the extending portions 33*a*) to the sheet P through the protective film 23 and the conveyor belt 8 and flows from the sheet P to the electrode 34 (the extending portions 34*a*) through the conveyor belt 8 and the protective film 23. The resistance value of the sheet P in this instance is considerably higher than that of the nip roller 4. Accordingly, the overall resistance value in this current path is higher than the overall resistance value in the current path that passes through nip roller 4. Therefore, even though the same potentials are given to the electrodes 33, 34, the current value becomes larger in an instance where the current path passes through the nip roller 4 than in an instance where the current path does not pass through the nip roller 4. In this respect, the Johnsen-Rahbeck force that acts between the conveyor belt 8 and the sheet P, namely, the attraction force by the attraction platen 22, increases with an increase in the electric current flowing between the conveyor belt 8 and the sheet P. Accordingly, the attractive force is larger at the portion of the conveyor belt 8 that is opposed to the nip roller 4 than the other portion thereof, owing to the increased electric current.

The sheet P supplied from the sheet supply unit 1*b* is initially attracted to the surface 8*a* at the portion of the conveyor belt 8 at which the attraction force is considerably large as described above (i.e., at the portion that is opposed to the nip roller 4), and is subsequently conveyed in the conveyance direction while being held by and attracted to the outer surface 8*a* at the other portion of the conveyor belt 8 (i.e., the other portion that is not opposed to the nip roller 4). When the sheet P conveyed by the conveyor belt 8 while being attracted to the surface 8*a* of the conveyor belt 8 passes right below the four ink-jet heads 10 in order, namely, passes through a region that is opposed to the ejection surfaces 10*a*, the ink-jet heads 10 controlled by the controller 1*p* eject the respective different colors of inks toward the sheet P, so that a desired color image is formed on the sheet P. The separation plate 5 is disposed so as to face the belt roller 7 and is configured to separate the sheet P from the surface 8*a* and to guide the sheet P toward the downstream side in the conveyance direction.

The maintenance unit 60 includes a main wiping mechanism 61 disposed near the lower side of the conveyor unit 21 and a sub wiping mechanism 62 disposed near the upper side of the conveyor unit 21. The main wiping mechanism 61 is disposed so as to face the lower portion of the loop of the conveyor belt 8. A platen 9 supporting the lower portion of the loop of the conveyor belt 8 from the inside of the loop is disposed at a position which is inside the conveyor belt 8 and at which the platen 9 is opposed to a main wiper 41 of the main wiping mechanism 61 with the conveyor belt 8 interposed therebetween. Owing to the presence of the platen 9, the conveyor belt 8 is prevented from sagging due to a pressing force by the wiper 41 when the wiper 41 removes the foreign substances from the conveyor belt 8, thereby effectively ensuring good wiping performance. The concrete structure of the maintenance unit 60 will be later explained in detail with reference to FIGS. 3-5.

As shown in FIG. 1, each of the heads 10 is a line-type head having a generally rectangular parallelepiped shape that is long in the main scanning direction. The lower surface of each head 10 is formed as the ejection surface 10*a* in which a multiplicity of ejection openings are open. When a recording operation (image forming operation) is conducted, the black ink, the magenta ink, the cyan ink, and the yellow ink are ejected form the ejection surfaces 10*a* of the respective four heads 10. The heads 10 are arranged at a suitable pitch in the sub scanning direction and are held by the housing 1*a* via a head holder 3. The head holder 3 holds the heads 10 such that the ejection surfaces 10*a* of the respective heads 10 are opposed to the surface 8*a* at the upper portion of the loop of the conveyor belt 8 and such that a clearance suitable for recording is formed between the ejection surfaces 10*a* and the surface 8*a* of the conveyor belt 8.

The guide unit includes an upstream-side guide portion and a downstream-side guide portion disposed on opposite sides of the conveyor unit 21 in the conveyance direction. The upstream-side guide portion includes two guides 27*a*, 27*b* and a pair of feed rollers 26 and connects the sheet supply unit 1*b* that will be explained and the conveyor unit 21 to each other. The downstream-side guide portion includes two guides 29*a*, 29*b* and two roller pairs 28 and connects the conveyor unit 21 and the discharged-sheet receiving portion 31 to each other.

In the space B, the sheet supply unit 1*b* is disposed so as to be attachable to and detachable from the housing 1*a*. The sheet supply unit 1*b* includes a sheet tray 24 and a sheet supply roller 25. The sheet tray 24 is a box-like member opening upward and accommodates sheets P with a plurality of sizes. The sheet supply roller 25 is configured to pick up an uppermost one of the sheets P in the sheet tray 24 and to supply the sheet P to the upstream-side guide portion.

As described above, the sheet conveyance path is formed in the spaces A and B so as to extend from the sheet supply unit 1*b* to the discharged-sheet receiving portion 31 via the conveyor unit 21. On the basis of a record command received from an external device, the controller 1*p* drives a sheet supply motor 125 (FIG. 6) for driving the sheet supply roller 25, a feed motor 127 (FIG. 6) for driving the rollers of each guide portion, the conveyance motor 121 (FIG. 6), and so on. The sheet P supplied from the sheet tray 24 is fed to the conveyor unit 21 by the feed rollers 26. On this occasion, the controller 1*p* controls the power source 36 such that the sheet P that is being conveyed on the conveyor belt 8 is attracted to the surface 8*a* of the conveyor belt 8. When the sheet P passes right below the heads 10 in the conveyance direction, the mutually different colors of ink are ejected, in order, from the respective heads 10, so that a color image is formed on the sheet P. The ink ejection operation is conducted on the basis of a detection signal from a sheet sensor 20. Thereafter, the sheet P is separated from the surface 8*a* by the separation plate 5 and is conveyed upward by the two roller pairs 28. Finally, the sheet P is discharged to the discharged-sheet receiving portion 31 through an upper opening 30.

In the space C, a cartridge unit 1*c* is disposed so as to be attachable to and detachable from the housing 1*a*. The cartridge unit 1*c* includes a tray 35 and the four cartridges 39 arranged in the tray 35. The inks in the respective cartridges 39 are supplied to the corresponding heads 10 through respective tubes (not shown).

Figure 3:
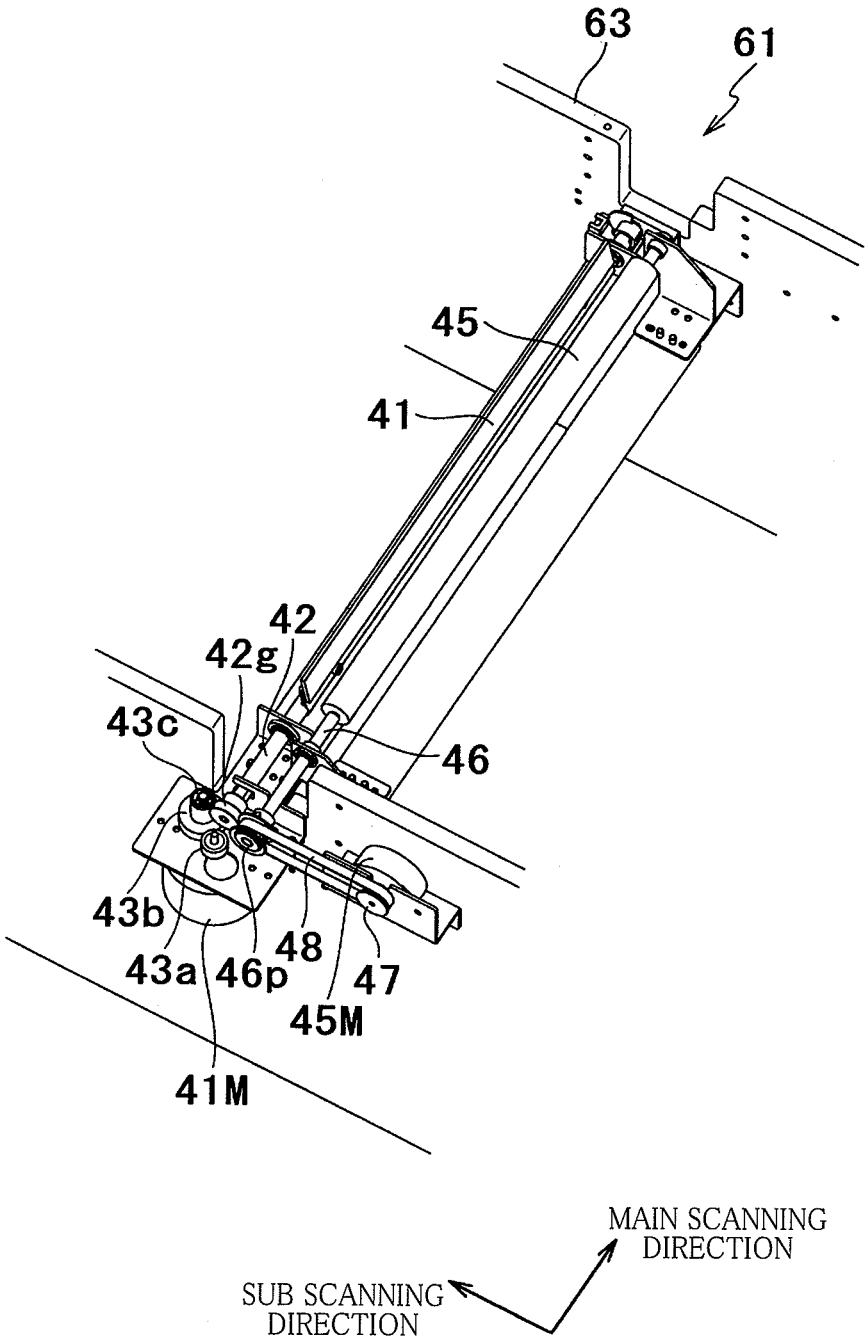
FIG. 3 is a perspective view schematically showing a main wiping mechanism of a maintenance unit shown in FIG. 1.
Figure 4:
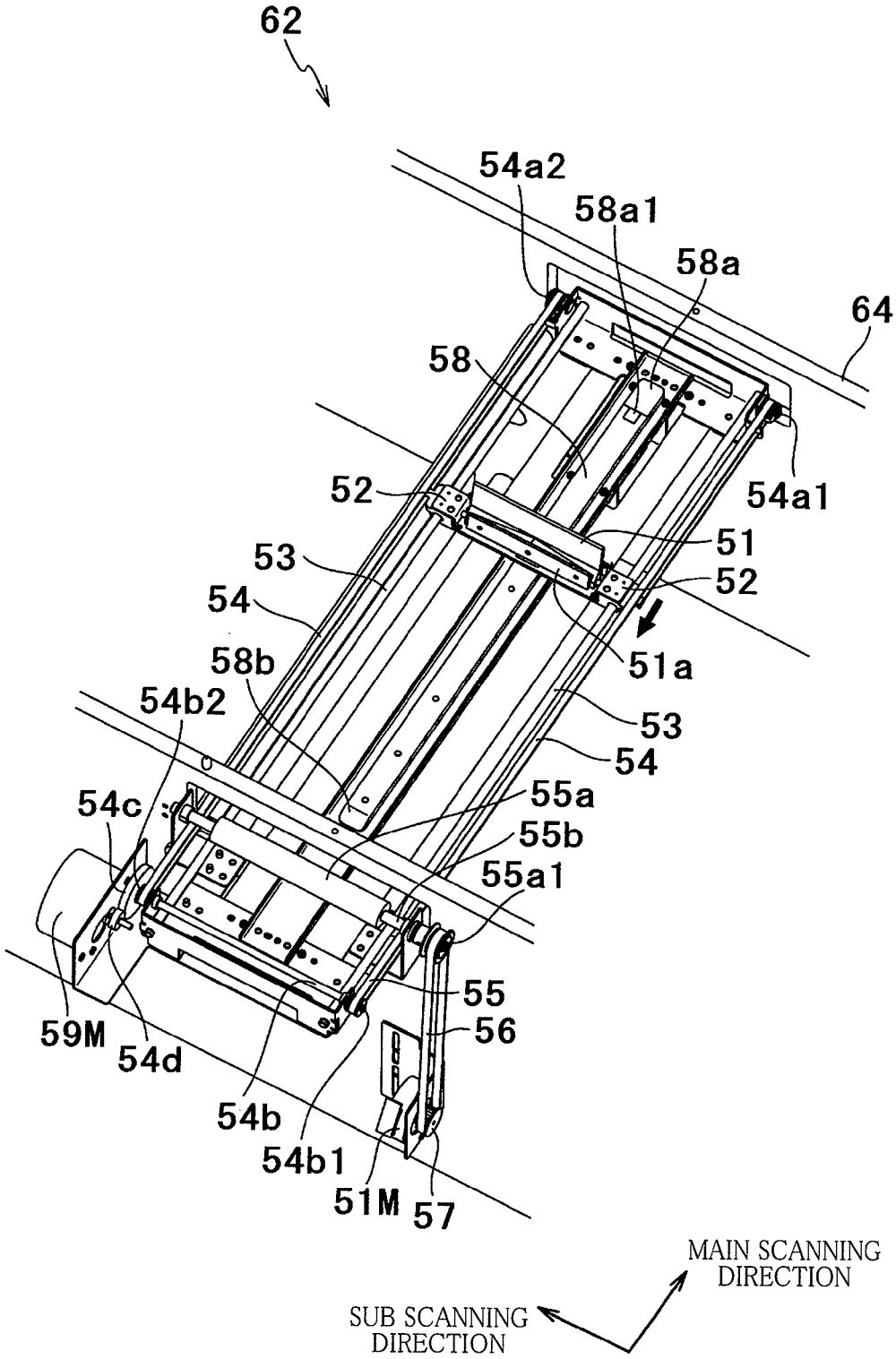
FIG. 4 is a perspective view schematically showing a sub wiping mechanism of the maintenance unit shown in FIG. 1.

Referring next to FIGS. 3-5, the maintenance unit 60 will be explained. In FIGS. 4 and 5, the sub wiping mechanism 62 of FIG. 1 is illustrated upside down for easier understanding.

As shown in FIG. 3, the main wiping mechanism 61 of the maintenance unit 60 includes the main wiper 41 and a wiper cleaner 45. The main wiper 41 is a plate-like member formed of an elastic material such as rubber and is used in a first wiping operation explained below. The main wiper 41 extends in the main scanning direction. The proximal or lower end of the main wiper 41 is fixed to a circumferential surface of a shaft 42. The shaft 42 extends in the main scanning direction and is supported by a frame 63 so as to be rotatable, together with the main wiper 41, about an axis extending in the main scanning direction. The frame 63 is fixed to the housing 1*a* (FIG. 1).

The main wiping mechanism 61 includes, as constituent components for rotating the shaft 42, a gear 43*a* fixed to an output shaft of a motor 41M, a gear 43*b* which is in mesh with the gear 43*a*, and a worm gear 43*c* which rotates by a rotation of the gear 43*b*. At one end of the shaft 42, there is provided a worm wheel 42*g* which is in mesh with a circumferential surface of the worm gear 43*c*. When the gears 43*a*, 43*b*, 43*c* are rotated by driving of the motor 41M, the worm wheel 42 is rotated, whereby the shaft 42 is rotated about the axis extending in the main scanning direction and an inclination angle of the main wiper 41 with respect to the horizontal plane changes, namely, the main wiper 41 rotates or pivots about the axis extending in the main scanning direction.

The inclination angle of the main wiper 41 is controlled by the controller 1*p* such that the vicinity of the distal end of the main wiper 41 is held in contact with the surface 8*a* of the conveyor belt 8 while being flexed or warped in a period during which the first wiping operation is conducted and such that the distal end of the main wiper 41 is away from the surface 8*a* of the conveyor belt 8 in a period other than the first wiping operation. Further, the inclination angle of the main wiper 41 is controlled by the controller 1*p* such that the distal end of the main wiper 41 is away from the wiper cleaner 45 in a period other than a wiper cleaning operation that will be explained.

The main wiper 41 has a length in the main scanning direction that is slightly larger than the width of the conveyor belt 8 and is disposed over the entire width of the conveyor belt 8. That is, the main wiper 41 is disposed such that the center thereof in the main scanning direction coincides with the center of the conveyor belt 8 in its width direction and such that longitudinally opposite ends of the main wiper 41 protrude from respective widthwise opposite ends of the conveyor belt 8 in plan view. Accordingly, when the main wiper 41 wipes the conveyor belt 8, the distal end of the main wiper 41 is held in contact with the conveyor belt 8 over the entire width thereof.

The wiper cleaner 45 is used in the wiper cleaning operation and is formed of an absorbing member such as a sponge. The wiper cleaner 45 has a cylindrical shape extending in the main scanning direction and is supported by a shaft 46 such that its axis coincides with the axis of the shaft 46. The shaft 46 extends in the main scanning direction and is supported by the frame 63 so as to be rotatable, together with the wiper cleaner 45, about an axis extending in the main scanning direction.

The main wiping mechanism 61 includes, as constituent components for rotating the shaft 46, a pulley 47 fixed to an output shaft of a motor 45M, a pulley 46*p* fixed to one end of the shaft 46, and a belt 48 wound around the pulley 46*p* and the pulley 47. When the pulley 47 is rotated by driving of the motor 45M, the belt 48 is moved and the pulley 46*p* is rotated. Accordingly, the shaft 46 is rotated about the axis extending in the main scanning direction, together with the wiper cleaner 45.

As shown in FIGS. 1 and 4, the sub wiping mechanism 62 of the maintenance unit 60 includes a sub wiper 51 and a sub wiper cleaner 55*a*, and is disposed at a position where the conveyor belt 8 is interposed between the sub wiping mechanism 62 and the downstream end portion of the base member 32 in the conveyance direction. That is, the sub wiping mechanism 62 is disposed so as to be opposed to the downstream end portion of the base member 32 in the conveyance direction. The sub wiper 51 is a plate-like member formed of an elastic material such as rubber and is used in a second wiping operation that will be explained. The sub wiper 51 extends in the sub scanning direction. The proximal end of the sub wiper 51 (the lower end of the sub wiper 51 as seen in FIG. 4) is fixed to a wiper supporter 51*a*. The wiper supporter 51*a* extends in the sub scanning direction and is supported by a frame 64 such that the wiper supporter 51*a* is rotatable, together with the sub wiper 51, about an axis extending in the sub scanning direction, and such that the wiper supporter 51 is movable in the main scanning direction. Like the frame 63, the frame 64 is fixed to the housing 1*a* (FIG. 1).

At opposite ends of the wiper supporter 51*a* in the sub scanning direction, sliders 52 are provided. The wiper supporter 51*a* is supported by a pair of sliders 52 so as to be rotatable about the axis extending in the sub scanning direction. The sub wiper 51 and the wiper supporter 51*a* are biased clockwise in FIG. 5A by a biasing member (not shown) such as a spring. The pair of sliders 52 are supported by a pair of bars 53 so as to be movable in the main scanning direction. Each bar 53 extends in the main scanning direction and is inserted through a corresponding one of the sliders 52.

The sub wiping mechanism 62 includes, as constituent components for moving the sub wiper 51 in the main scanning direction, a pair of belts 54 each of which is fixed, at a lower portion of the loop thereof, to a corresponding one of the sliders 52, pulleys 54*a*1, 54*a*2 around which the respective belts 54 are wound, a roller 54*b* having opposite ends around which the respective belts 54 are wound, and pulleys 54*b*1, 54*b*2 respectively provided at the opposite ends of the roller 54*b*. As the constituent components described above, the sub wiping mechanism 62 further includes a gear 54*c* which rotates integrally with the pulley 54*b*2 and a gear 54*d* which is in mesh with the gear 54*c* and which is fixed to an output shaft of a motor 59M. When the gears 54*c*, 54*d* are rotated by driving of the motor 59M, the pulley 54*b*2 is rotated. The rotation of the pulley 54*b*2 causes the roller 54*b* to be rotated, whereby the pair of belts 54 are moved. Accordingly, the sliders 52 are moved in the main scanning direction while supporting the wiper supporter 51*a*.

Figure 5A:
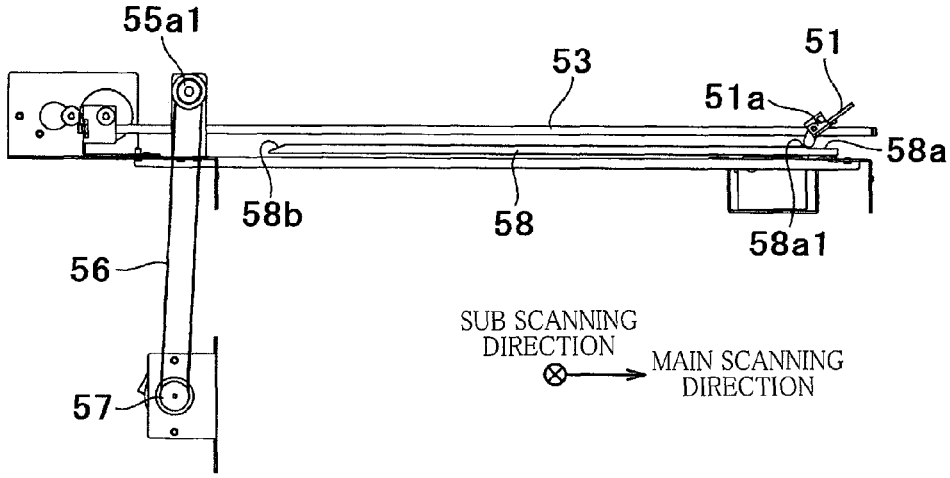
FIGS. 5A-5G are views for explaining an operation of a sub wiper.

The sub wiping mechanism 62 includes, as a constituent component for rotating or pivoting the sub wiper 51, a plate 58 disposed under the wiper supporter 51*a*. The plate 58 is elongate in the main scanning direction and is disposed in parallel with the horizontal plane. As shown in FIG. 5A, in a period during which the sub wiper 51 moves in the main scanning direction, the lower end of the wiper supporter 51*a* as seen in FIG. 5A is held in sliding contact with the surface of the plate 58.

The surface of the plate 58 (the upper surface of the plate 58 as seen in FIGS. 4 and 5) is flat except its opposite ends in the main scanning direction. A stepped surface 58*a* is formed at one end of the plate 58 in the main scanning direction, namely, at an upstream end of the plate 58 in a moving direction of the sub wiper 51 (indicated by the arrow in FIG. 4) in the second wiping operation. An inclined surface 58*b* is formed at the other end of the plate 58 in the main scanning direction. The height level of the stepped surface 58*a* is lower than that of the other portion (the flat portion) of the surface of the plate 58 except the opposite ends thereof. A protruding portion 58*a*1 is formed at a boundary between the stepped surface 58*a* and the flat portion of the surface of the plate 58. The protruding portion 58*a*1 is movable selectively between a protruding position at which the protruding portion 58*a*1 protrudes upward from the flat portion of the surface of the plate 58 except the opposite ends thereof in the main scanning direction and a retracted position at which the protruding portion 58*a*1 is located at the same height level as the flat portion. The protruding portion 58*a*1 is biased upward and is located at the protruding position in a state in which no external force is being applied to the protruding portion 58*a*1.

The sub wiper cleaner 55*a* is a cleaning member for cleaning the sub wiper 51 after completion of the second wiping operation and is formed of an absorbing member such as a sponge. The sub wiper cleaner 55*a* has a cylindrical shape extending in the sub scanning direction and is supported by a shaft 55*b* such that its axis coincides with the axis of the shaft 55. The shaft 55 extends in the sub scanning direction and is supported by the frame 64 so as to be rotatable, together with the sub wiper cleaner 55, about an axis extending in the sub scanning direction. The sub wiping mechanism 62 includes, as constituent components for rotating the shaft 55*b*, a pulley 57 fixed to an output shaft of the motor 51M, a pulley 55*a*1 fixed to one end of the shaft 55*b*, and a belt 56 wound around the pulley 57 and the pulley 55*a*1. When the pulley 57 is rotated by driving of the motor 51M, the belt 56 is moved and the pulley 55*a*1 is rotated, whereby the shaft 55*b* is rotated about the axis extending in the sub scanning direction, together with the sub wiper cleaner 55*a*.

The sub wiping mechanism 62 includes an accommodating portion 65 (FIG. 2) for accommodating foreign substances scraped away by the sub wiper 51 from the surface 8*a* of the conveyor belt 8 in the second wiping operation. The accommodating portion 65 is composed of an absorbing member 65*a* formed of a porous material such as a sponge and a casing 65*b* in which the absorbing member 65*a* is accommodated. The accommodating portion 65 is fixed to one side surface of the attraction platen 22. The absorbing member 65*a* is exposed to an upper opening of the casing 65*b* and is disposed such that the upper surface of the absorbing member 65*a* has the same height level as the surface 8*a* of the upper portion of the loop of the conveyor belt 8.

There will be hereinafter explained an operation of the sub wiper 51 in the second wiping operation. It is noted that the second wiping operation is an operation in which the sub wiper 51 wipes the foreign substances off the surface 8*a* by moving in the main scanning direction while being in contact with the surface 8*a*.

In a period other than the second wiping operation, the sub wiper 51 is kept stationary at a home position which is the one end of the plate 58 in the main scanning direction, such that the sub wiper 51 is inclined at an angle that permits the distal end of the sub wiper 51 not to contact the surface 8*a* while facing the surface 8*a* in the vertical direction. In this instance, a lower end 51*a*1 (as seen in FIG. 5B) of the wiper supporter 51*a* is held in abutting contact with a slant face of the protruding portion 58*a*1 nearer to the stepped surface 58*a*.

Figure 5B:
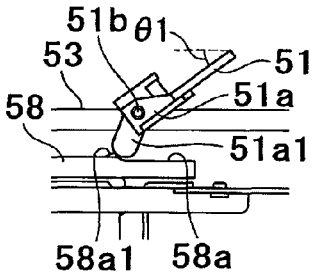
Figure 5C:
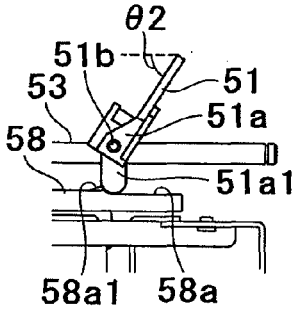
Figure 5D:
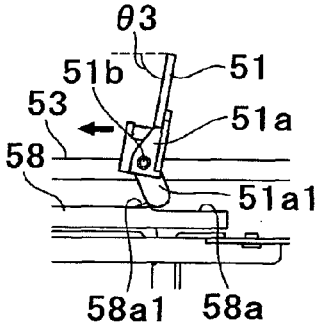
Figure 5E:
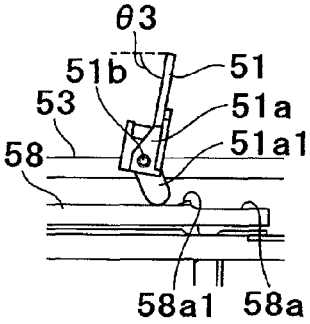
Figure 5F:
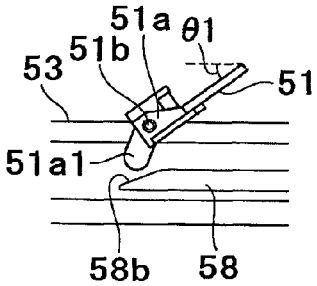

In the second wiping operation, when the sliders 52 are about to move in the main scanning direction as a result of driving of the motor 59M, the lower end 51*a*1 of the wiper supporter 51*a* rotates while being held in contact with the above-indicated slant face of the protruding portion 58*a*1, as shown in FIGS. 5B, 5C, and 5D. Accordingly, the sub wiper 51, together with the wiper supporter 51*a*, rotates or pivots about the axis extending in the sub scanning direction, against the biasing force of the biasing member, and the inclination angle of the sub wiper 51 with respect to the horizontal plane changes so as to gradually increase from θ1 to θ3, so that the distal end of the sub wiper 51 comes into contact with the surface 8*a* of the conveyor belt 8. When the sliders 52 further move in the main scanning direction, the protruding portion 58*a*1 is pushed downward by the lower end 51*a*1, so that the protruding portion 58*a*1 is moved to the retracted position at which the protruding portion 58*a*1 is located at the same height level as the flat portion of the surface of the plate 58 except the opposite ends thereof in the main scanning direction. When the sliders 52 further move in the main scanning direction, the lower end 51*a*1 of the wiper supporter 51*a* passes over the protruding portion 58*a*1 and the inclination angle of the sub wiper 51 with respect the horizontal plane becomes maximum, namely, becomes equal to θ3. On this occasion, though the biasing force by the biasing member is acting on the sub wiper 51 and the wiper supporter 51*a*, namely, though the force to change the inclination angle of the sub wiper 51 from θ1 to θ3 is acting on the sub wiper 51 and the wiper supporter 51*a*, the inclination angle of the sub wiper 51 is maintained at the angle of θ3 because the lower end 51*a*1 of the wiper supporter 51*a* is supported on the surface of the plate 58. In this state, the sub wiper 51 moves in the main scanning direction with its distal end being held in contacting with the surface 8*a* of the conveyor belt 8. Immediately before the sub wiper 51 reaches the other end of the plate 58 in the main scanning direction, the distal end of the sub wiper 51 reaches a position at which the distal end comes into contact with the absorbing member 65*a*, and the foreign substances scraped by the sub wiper 51 are absorbed by the absorbing member 65*a* and are accommodated in the accommodating portion 65. Finally when the sub wiper 51 reaches the other end of the plate 58 in the main scanning direction and the lower end 51*a*1 of the wiper supporter 51*a* reaches the inclined surface 58*b*, the lower end 51*a*1 separates away from the surface (the inclined surface 58*b*) of the plate 58, as shown in FIG. 5F. Accordingly, the sub wiper 51, together with the wiper supporter 51*a*1, rotates or pivots about the axis extending in the sub scanning direction by the biasing force of the biasing member, and the inclination angle of the sub wiper 51 with respect to the horizontal plane changes from θ3 again to θ1, so that the distal end of the sub wiper 51 separates away from the surface 8*a* of the conveyor belt 8. It is noted that the moving speed of the sub wiper 51 in the main scanning direction is set to be higher a relative moving speed of the main wiper 41 and the conveyor belt 8 in the first wiping operation in which the surface 8*a* is wiped by the main wiper 41.

Figure 5G:
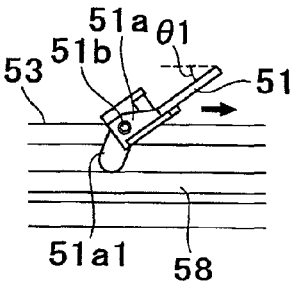

After the second wiping operation, the sub wiper 51 is moved to a position at which the distal end of the sub wiper 51 comes into contact with the sub wiper cleaner 55*a* in a state in which the inclination angle of the sub wiper 51 with respect to the horizontal plane is maintained at θ1 and the distal end thereof is away from the surface 8*a*. After the distal end of the sub wiper 51 has been cleaned by the sub wiper cleaner 55*a*, the sub wiper 51 moves in the main scanning direction toward the home position, as shown in FIG. 5G. In the neighborhood of the home position, the lower end 51*a*1 of the wiper supporter 51*a* comes into contact with a slant face of the protruding portion 58*a*1 remote from the stepped surface 58*a* and passes over the protruding portion 58*a*1 while pushing the protruding portion 58*a*1 downward. Thereafter, the sub wiper 51 stops at the home position in a state in which the inclination angle of the sub wiper 51 with respect to the horizontal plane is maintained at θ1 and the distal end thereof is away from the surface 8*a*.

The inclination angles θ2 and θ3 are set such that the vicinity of the distal end of the sub wiper 51 contacts the surface 8*a* of the conveyor belt 8 while being flexed or warped. Further, the inclination angle θ3 is set such that the pressing force of the sub wiper 51 onto the surface 8*a* of the conveyor belt 8 is smaller than the pressing force of the main wiper 41 onto the surface 8*a* in the first wiping operation. More specifically, a distance between: an axis 51*b* which is a center axis of the pivotal movement of the sub wiper 51; and the surface 8*a* of the conveyor belt 8 is made larger than a distance between: the shaft 42 which is a center axis of the pivotal movement of the main wiper 41; and the surface 8*a* of the conveyor belt 8. It is noted that, even where those two distances are the same, the inclination angle θ3 of the sub wiper 51 with respect to the horizontal plane in the second wiping operation may be set to be smaller than the inclination angle of the main wiper 41 with respect to the horizontal plane in the first wiping operation. That is, the inclination angle of the main wiper 41 with respect to the horizontal plane in the first wiping operation may be set to be larger than the inclination angle θ3.

In other words, the wiping ability of the sub wiper 51 for wiping off the foreign substances from the surface 8*a* is made smaller than the wiping ability of the main wiper 41. Because the pressing force by the sub wiper 51 is thus made smaller than that by the main wiper 41, a frictional force between the sub wiper 51 and the surface 8*a* in the second wiping operation is small, whereby the conveyor belt 8 is unlikely to be moved or shifted in the main scanning direction when the sub wiper 51 moves in the main scanning direction. Further, the foreign substances can be surely gathered, as described below, to a narrow region by the main wiper 41 that exerts a large pressing force on the surface 8*a* while the foreign substances gathered to the narrow region can be removed by the sub wiper 51 that exerts a small pressing force on the surface 8*a*, without shifting the conveyor belt 8. In this respect, even where the pressing force of the sub wiper 51 is made small, an intended amount of the foreign substances can be removed from the surface 8*a* because the sub wiper 51 and the surface 8*a* of the conveyor belt 8 are held in contact with each other. That is, the sub wiper 51 is arranged to remove the foreign substances remaining when the main wiper 41 separates away from the surface 8*a*, namely, the sub wiper 51 is arranged to remove the foreign substances gathered to the narrow region by the main wiper 41, and the amount of the foreign substances that remains after the wiping operation by the sub wiper 51 without being completely wiped off is small. Accordingly, any serious problems will occur. Here, serious problems refer to attaching of the foreign substances on the surface 8*a*, to the back surface of the sheet P that is being conveyed by the conveyor belt 8 and conveyance failure in which the conveyor belt 8 fails to convey the sheet P due to a reduction of the attraction force of the conveyor belt 8 with respect to the sheet P caused by the foreign substances on the surface 8*a*. While, in the present embodiment, the pressing force of the sub wiper 51 onto the surface 8*a* is made smaller than the pressing force of the main wiper 41 onto the surface 8*a*, the pressing force larger than that of the main wiper 41 may be applied to the surface 8*a* by the sub wiper 51.

In the present embodiment, the constituent components (such as the belts 54) for moving the sub wiper 51 in the main scanning direction are disposed to extend over the entire width of the conveyor belt 8. Accordingly, in the second wiping operation, the sub wiper 51 moves from one of widthwise opposite ends of the conveyor belt 8 to the other ends thereof, with the vicinity of the distal end flexed and held in contact with the surface 8*a* of the conveyor belt 8, whereby the sub wiper 51 removes the foreign substances over the entire width of the conveyor belt 8. The foreign substances removed by the main wiper 41 are accommodated in a pan (not shown) located below the main wiper 41 while the foreign substances removed by the sub wiper 51 are accommodated in the accommodating portion 65 described above.

Figure 6:
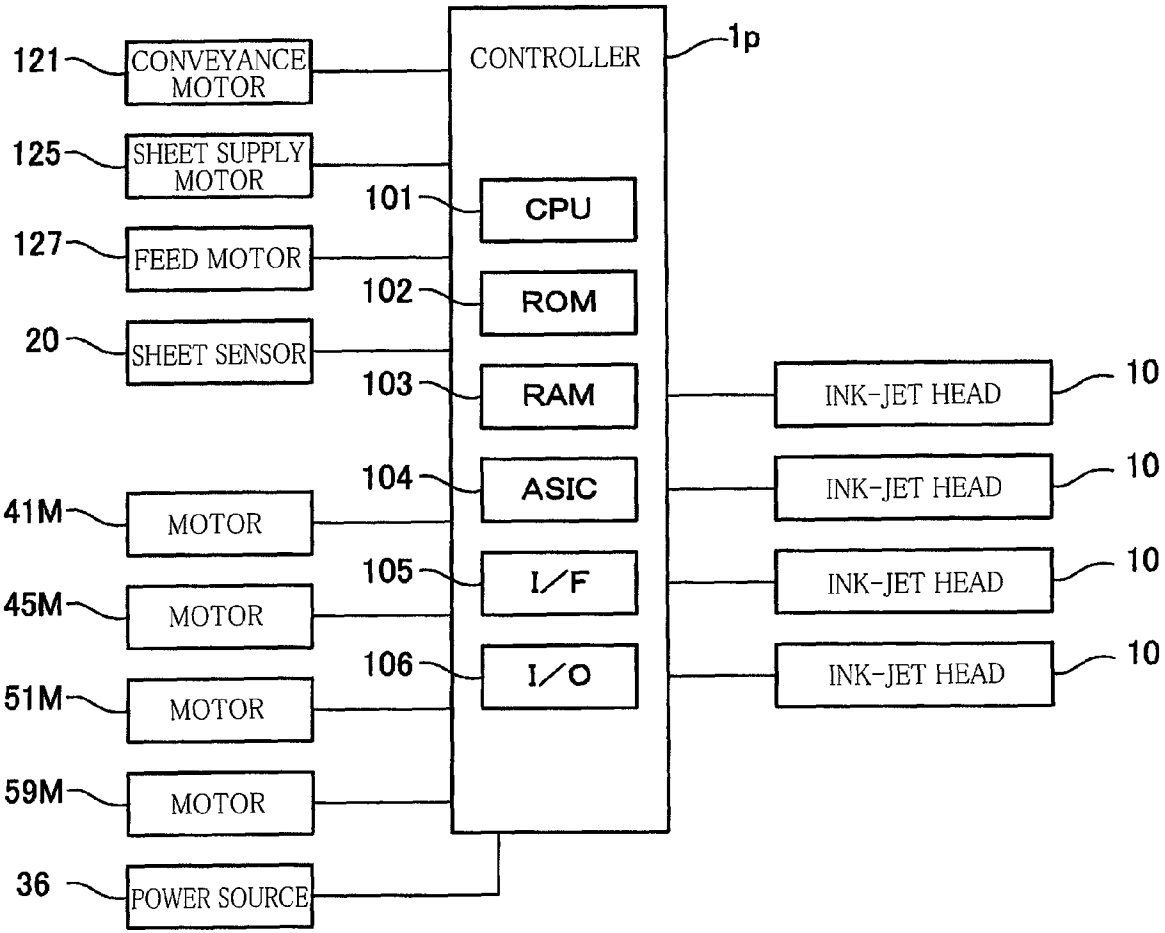
FIG. 6 is a block diagram showing an electric structure of the printer.
Figure 7:
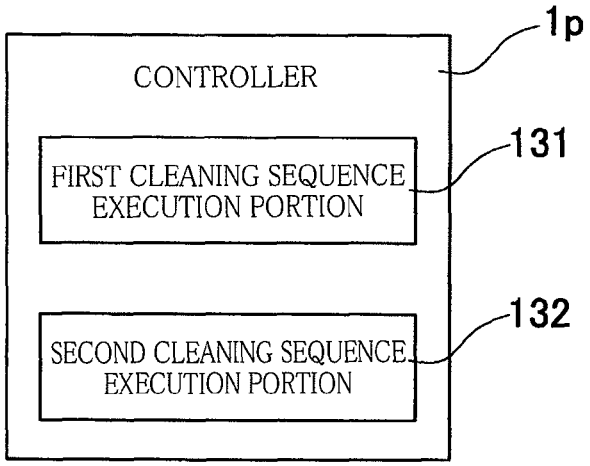
FIG. 7 is a block diagram showing a schematic structure of a controller shown in FIG. 1.

Referring next to FIGS. 6 and 7, the electric structure of the printer 1 will be explained. As shown in FIG. 6, the controller 1*p* includes a Central Processing Unit (CPU) 101 as an arithmetic processing unit, a Read Only Memory (ROM) 102, a Random Access Memory (RAM) 103 including nonvolatile RAM, an Application Specific Integrated Circuit (ASIC) 105, an Interface (I/F) 105, and an Input/Output Port (I/O) 106. There are stored, in the ROM 102, programs to be executed by the CPU 101, various fixed data, and the like. There are temporarily stored, in the RAM 103, data necessary when the programs are executed, such as image data of an image to be recorded on the sheet P. In the ASIC 104, rewriting and sorting of the image data such as signal processing and image processing are executed. The I/F 105 executes transmission and reception of data with an external apparatus. The I/O 106 executes input/output of detection signals of various sensors.

The controller 1*p* is connected to the motors 121, 125, 127, 41M, 45M, 51M, 59M, the sheet sensor 20, the power source 36, a control circuit board of the heads 10, and so on. The controller 1*p* further includes functional portions such as a first cleaning sequence execution portion 131 and a second cleaning sequence execution portion 132 constituted by the hardware described above.

The first cleaning sequence execution portion 131 is configured to control, on the basis of a wiping command that will be explained, the motor 41M and the conveyance motor 121 such that the first wiping operation for wiping the foreign substances on the surface 8*a* is conducted. In the first wiping operation, the distal end of the main wiper 41 that is away from the surface 8*a* is brought into contact with the surface 8*a* and the main wiper 41 and the surface 8*a* are moved relative to each other in the conveyance direction, whereby the foreign substances on the surface 8*a* are wiped.

The second cleaning sequence execution portion 132 is configured to control, on the basis of the wiping command, the motor 59M such that the second wiping operation for wiping the foreign substances on the surface 8*a* is conducted. In the second wiping operation, the distal end of the sub wiper 51 that is away from the surface 8*a* is brought into contact with the surface 8*a* and the sub wiper 51 and the surface 8*a* are moved relative to each other in the main scanning direction, whereby the foreign substances on the surface 8*a* are wiped. Further, the second cleaning sequence execution portion 132 is configured to control, on the basis of the wiping command, the power source 36 such that the attraction force by which the conveyor belt 8 is attracted to the attraction platen 22 is generated. It is noted that a wiper driving mechanism for moving the sub wiper 51 is constituted by a portion of the sub wiping mechanism 62 that includes the motor 59M.

Figure 8:
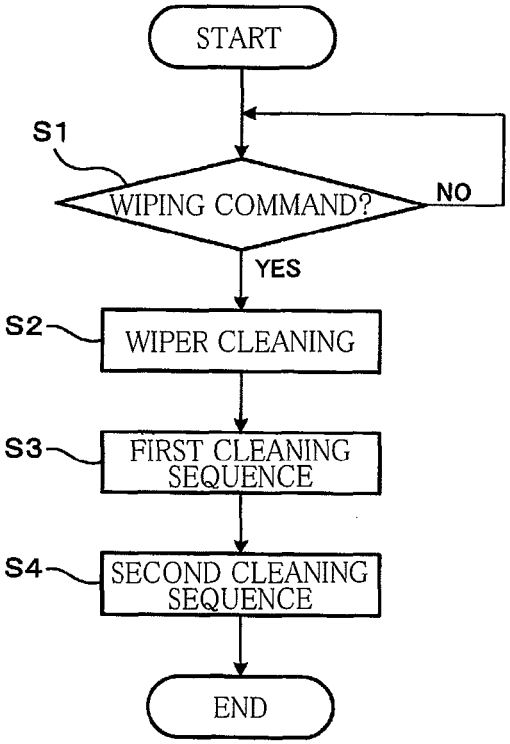
FIG. 8 is a flow chart showing details of maintenance executed by the controller of the printer.

Referring next to the flow chart of FIG. 8, the details of the maintenance to be executed by the controller 1*p* will be explained. The processing described below is executed by the CPU 101 according to the programs stored in the ROM 102. As shown in FIG. 8, it is initially judged whether the wiping command is received or not (Step 1: S1). The wiping command is received after the printer 1 is turned on, at a time when purging or preliminary ejection toward the surface 8*a* of the conveyor belt 8 is completed, and at a time when paper jamming occurs, for instance.

The controller 1*p* continues to stand by unless the wiping command is received in Step 1 (S1: NO). Where the wiping command is received in Step 1 (S1: YES), Step 2 (S2) is implemented.

In Step 2, the controller 1*p* drives the motor 41M so as to rotate or pivot the main wiper 41 clockwise in FIG. 1 about the axis extending in the main scanning direction, in a state in which the movement of the conveyor belt 8 is halted. When the main wiper 41 rotates or pivots, the distal end of the main wiper 41 comes into contact with the circumferential surface of the wiper cleaner 45 while being flexed. On this occasion, the foreign substances adhering to the distal end of the main wiper 41 attach to the wiper cleaner 45, so as to be removed from the distal end of the main wiper 41. In other words, the wiper cleaning is conducted.

The controller 1*p* is configured to rotate the wiper cleaner 45 by a prescribed angle smaller than 360 degrees every after one or several times of wiper cleaning (S2). According to the arrangement, a portion of the wiper cleaner 45 with which the distal end of the main wiper 41 comes into contact in the wiper cleaning changes in the circumferential direction of the wiper cleaner 45, in other words, the distal end of the main wiper 41 comes into contact with different portions of the circumferential surface of the wiper cleaner 45, whereby the foreign substances adhering to the distal end of the main wiper 41 can be effectively removed.

Subsequently, Step 3 (S3) is implemented. In Step 3, the first cleaning sequence execution portion 131 initially drives the conveyance motor 121 to run or move the conveyor belt 8 and stops driving of the conveyance motor 121 at timing when a predetermined wiping start area of the surface 8*a* is disposed above the distal end of the main wiper 41. Further, the first cleaning sequence execution portion 131 drives the motor 41M so as to slightly rotate or pivot the main wiper 41 about the axis extending in the main scanning direction, whereby the distal end of the main wiper 41 located away from the surface 8*a* of the conveyor belt 8 is brought into contact with the wiping start area. At timing when the distal end of the main wiper 41 comes into contact with the surface 8*a* while being flexed, the first cleaning sequence execution portion 131 stops driving of the motor 41M. Subsequently, the first cleaning sequence execution portion 131 again drives the conveyance motor 121 so as to permit the conveyor belt 8 to run or move one or several rounds, whereby the foreign substances on the surface 8*a* of the conveyor belt 8 are removed from the surface 8*a* while being gathered to the narrow region of the surface 8*a*, by the main wiper 41. In this way, the first wiping operation is conducted. After the conveyor belt 8 has run or moved one or several rounds, the first cleaning sequence execution portion 131 stops driving of the conveyance motor 121 when the distal end of the main wiper 41 is being in contact with the wiping start area. Thereafter, in a state in which the movement of the conveyor belt 8 is halted, the first cleaning sequence execution portion 131 drives the motor 41M so as to slightly rotate or pivot the main wiper 41 about the axis extending in the main scanning direction, whereby the distal end of the main wiper 41 is separated away from the wiping start area of the surface 8*a*. In the present embodiment, the main wiper 41 that is being in contact with the surface 8*a* is separated away therefrom after the first cleaning operation, always at a position corresponding to the wiping start area of the surface 8*a*.

Subsequently, Step 4 (S4) is implemented. In Step 4, the second cleaning sequence execution portion 132 drives the conveyance motor 121 so as to run or move the conveyor belt 8 and stops driving of the conveyance motor 121 at timing when the wiping start area of the surface 8*a* is opposed to the sub wiper 51, namely, when the wiping start area is disposed below the sub wiper 51. Further, the second cleaning sequence execution portion 132 controls the power source 36 such that the attraction force is generated between the conveyor belt 8 and the attraction platen 22. Thus, a region of the conveyor belt 8 facing the attraction platen 22 is attracted to the upper surface of the attraction platen 22. More specifically, as in an instance where the sheet P is attracted to the conveyor belt 8, there flows, in a region of the conveyor belt 8 facing the nip roller 4, an electric current larger than an electric current which flows in a region of the conveyor belt 8 facing the attraction platen 22. Therefore, the region of the conveyor belt 8 facing the nip roller 4 is attracted to the upper surface of the attraction platen 22 by an attraction force larger than an attraction force by which the region of the conveyor belt 8 facing the attraction platen 22 is attracted. Accordingly, the conveyor belt 8 is unlikely to be shifted when the second wiping operation is conducted. Further, in this instance, the second cleaning sequence execution portion 132 controls the power source 36 to give, to the electrode 33, a potential larger than a potential which is given thereto when the sheet P is conveyed by the conveyor belt 8 while being attracted. Hence, the conveyor belt 8 is more unlikely to be shifted when the second wiping operation is conducted. In addition, because the attraction force of the attraction platen 22 to the conveyor belt 8 at a time when the second wiping operation is conducted is larger than the attraction force of the attraction platen 22 to the conveyor belt 8 at a time when the sheet P is conveyed, it is possible to reduce a conveyance load when the sheet P is conveyed.

Further, the second cleaning sequence execution portion 132 drives the motor 59M in a forward direction, whereby the distal end of the sub wiper 51 which is located away from the surface 8*a* of the conveyor belt 8 is brought into contact with the surface 8*a* (i.e., the wiping start area) and the sub wiper 51 subsequently moves from the home position in the main scanning direction. As a result, the foreign substances present on the wiping start area of the conveyor belt 8, namely, the foreign substances remaining on the surface 8*a* after the main wiper 41 has been separated away therefrom, are gathered to a narrow region on the surface 8*a* by the sub wiper 51. The gathered foreign substances are removed from the surface 8*a* by contacting of the sub wiper 51 with the absorbing member 65*a* of the accommodating portion 65. In this way, the second wiping operation is conducted. Thereafter, at timing when the sub wiper 51 reaches the other end of the plate 58 in the main scanning direction, the second cleaning sequence execution portion 132 once stops driving of the motor 59M and controls the power source 36 to stop application of the voltage to the electrodes 33, 34, thereby cancelling the attraction force between the conveyor belt 8 and the attraction platen 22. At this moment, the distal end of the sub wiper 51 is away from the absorbing member 65*a* of the accommodating portion 65 (FIG. 5F) and is held in contact with the sub wiper cleaner 55*a*. Thereafter, the second cleaning sequence execution portion 132 drives the motor 59M in a backward direction to thereby move the sub wiper 51 in the main scanning direction, such that the sub wiper 51 moves in a direction (FIG. 5G) opposite to the moving direction (indicated by the arrow in FIG. 4) in which the sub wiper 51 moves for removing the foreign substances. At timing when the sub wiper 51 reaches the home position, the second cleaning sequence execution portion 132 stops driving of the motor 59M. Thus, the first and second wiping operations are ended.

As explained above, in the printer 1 according to the present embodiment, the second wiping operation is conducted in a state in which the attraction force (the retaining force) by the attraction platen 22 is being given to the conveyor belt 8, so that the conveyor belt 8 is unlikely to move in the moving direction of the sub wiper 51. Accordingly, it is possible to maintain the conveyance accuracy at a time when the sheet P is conveyed by the conveyor belt 8.

The attraction force as the retaining force for retaining the conveyor belt 8 is generated by the attraction platen 22 configured to generate the attraction force for attracting the sheet P to the surface 8*a* of the conveyor belt 8. Accordingly, it is not necessary to additionally provide a mechanism to exclusively generate the retaining force for retaining the conveyor belt 8 when the second wiping operation is conducted, resulting in a simplified structure of the printer 1.

The sub wiper 51 is disposed at the position where the conveyor belt 8 is interposed between the sub wiper 51 and the attraction platen 22. That is, the attraction platen 22 attracts the region of another surface of the conveyor belt 8 which is opposite to the region of the surface 8*a* of the conveyor belt 8 to be wiped by the sub wiper 51 in the second wiping direction. Hence, even when the sub wiper 51 moves in the main scanning direction in the second wiping operation, it is possible to effectively prevent the conveyor belt 8 from being moved or shifted.

The printer 1 according to the present embodiment employs an electrostatic attraction portion for generating an electrostatic attraction force which is constituted by the power source 36 and the attraction platen 22 configured to attract the sheet P to the surface 8*a* of the conveyor belt 8. In place of the electrostatic attraction portion, the following arrangement may be employed. That is, a plurality of through-holes are formed through the thickness of the conveyor belt 8, and a pneumatic attraction portion is employed which is constituted by a fan or the like configured to suck the air through the through-holes. In the pneumatic attraction portion, the control similar to that of the electrostatic attraction portion is possible by controlling a suction force by the fan. More specifically, when the second wiping operation is conducted, a pneumatic attraction force is made higher than that when the sheet P is conveyed by the conveyor belt and the attraction force to be applied to the conveyor belt is accordingly increased, whereby the conveyor belt is more unlikely to move in the wiping direction of the sub wiper 51. Further, as described above, it is not necessary to additionally provide the mechanism for exclusively retaining the conveyor belt in the second wiping operation, resulting in a simplified structure of the printer.

There may be formed, in the conveyor belt, a non-through region in which no through-holes are formed, and the pneumatic attraction portion may be configured to suck the non-through region. This arrangement ensures a higher attraction force to be applied to the conveyor belt by the pneumatic attraction portion, so that the conveyor belt is more unlikely to move in the second wiping direction.

There may be disposed a plate member, for instance, for closing the plurality of through-holes formed in the conveyor belt, at a position where the conveyor belt is interposed between the plate member and the fan, and the plate member which is located away from the surface of the conveyor belt may be brought into contact with the surface when the second wiping operation is conducted. This arrangement ensures advantages similar to those obtained in the above arrangement in which the non-through region is formed in the conveyor belt. In this arrangement, since the non-through region is not formed in the conveyor belt, it is possible to convey the sheet P while sucking and holding the sheet P at any position of the conveyor belt.

Figure 9:
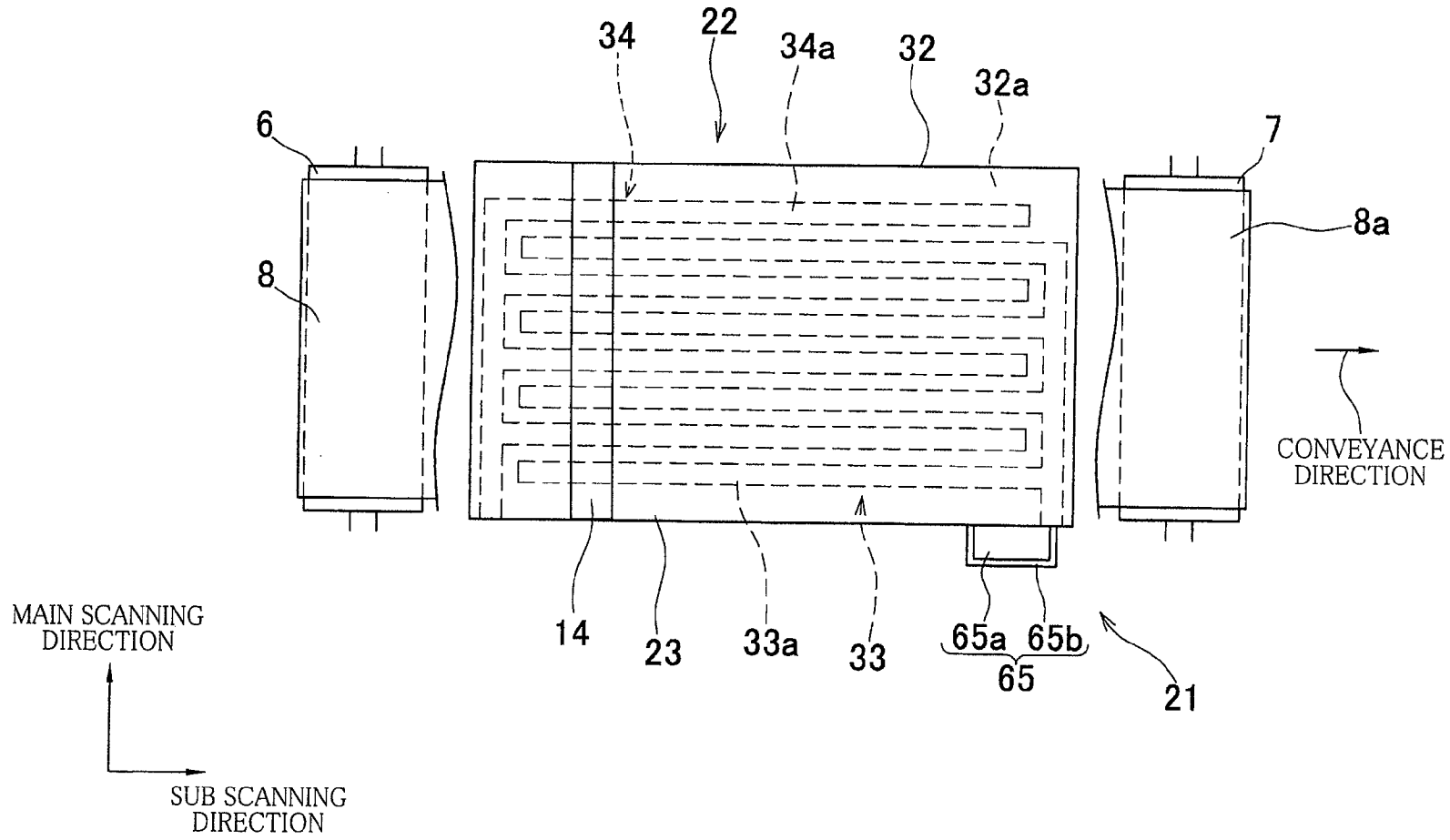
FIG. 9 is a plan view schematically showing a conveyor unit of an ink jet printer according to a first modified embodiment.

FIG. 9 shows a conveyor unit of an ink-jet printer according to a first modified embodiment of the invention. In the first modified embodiment, in place of the electrically conductive nip roller 4 provided in the printer 1 according to the illustrated embodiment, an electrically conductive layer 14 is formed on a part of the surface 8*a* of the conveyor belt 8 by attaching an electrically conductive film to the surface 8*a*. The electrically conductive layer 14 is formed to extend over the entire width of the conveyor belt 8 and has a dimension, as measured in the conveyance direction, which is not larger than the dimension of the attraction platen 22 as measured in the conveyance direction. When the second wiping operation is conducted, the controller 1*p* controls the conveyance motor 121 to be driven such that the electrically conductive layer 14 is located so as to be opposed to the attraction platen 22 (i.e., the electrodes 33, 34) and controls the power source 36 such that the attraction force is generated by the attraction platen 22. As in the above arrangement in which the electrically conductive nip roller 4 is provided, the electric current which flows through the part of the conveyor belt 8 on which the electrically conductive layer 14 is formed is large, resulting in a large attraction force applied by the attraction platen 22 to the part of the conveyor belt 8.

Figure 10:
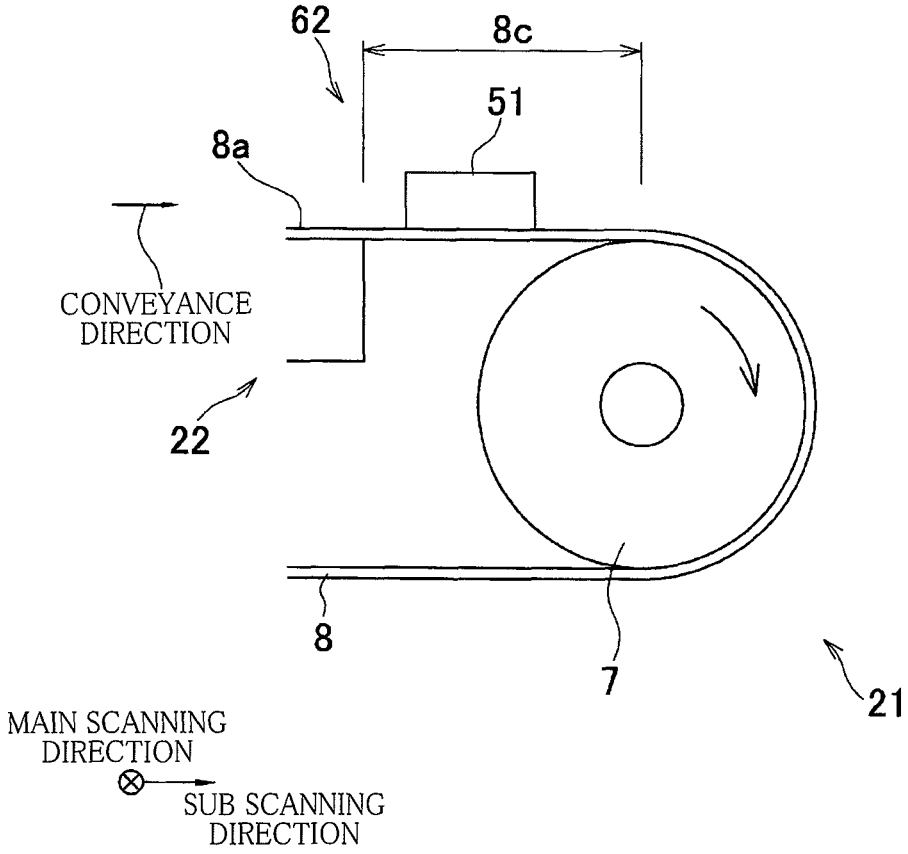
FIG. 10 is an enlarged view of a principal part of an ink-jet printer according to a second modified embodiment.

While, in the printer 1 according to the present embodiment, the sub wiping mechanism 62 (the sub wiper 51) is disposed so as to be opposed to the attraction platen 22, the sub wiping mechanism 62 may be disposed at a position as shown in FIG. 10. FIG. 10 shows a principal part of an ink-jet printer according to a second modified embodiment of the invention. In the second modified embodiment of the invention, the sub wiping mechanism 62 is disposed at a partial region 8*c* of the conveyor belt 8 which is downstream of a region of the conveyor belt 8 facing the attraction platen 22 and which is upstream of a region of the conveyor belt 8 where the conveyor belt 8 contacts the belt roller 7 for driving the conveyor belt 8, namely, a downstream one of the two rollers 6, 7, in the conveyance direction. In other words, the sub wiping mechanism 62 is disposed so as to be opposed to the partial region 8*c* as an intermediate region which is intermediate between the above-indicated two regions in the conveyance direction. More specifically, the sub wiper 51 is disposed so as to come into contact with and separate away from the partial region 8*c* which is a part of the upper portion of the loop of the conveyor belt 8 and which is located between the attraction platen 22 and the belt roller 7.

On the basis of the wiping command, the controller 1*p* (the second cleaning sequence execution portion 132) controls the conveyance motor 121 to drive the belt roller 7 in the same direction as the direction at the time of conveyance of the sheet P, such that there is applied, to the partial region 8*c* of the conveyor belt 8, tension larger than that to be applied to the other region of the conveyor belt 8, after the conveyor belt 8 has been attracted to the attraction platen 22 and before the second wiping operation is conducted.

More specifically, when the second wiping operation is conducted, the second cleaning sequence execution portion 132 executes, on the basis of the wiping command, the control similar to that in the illustrated embodiment, until the conveyor belt 8 is attracted by the attraction platen 22. Subsequently, the second cleaning sequence execution portion 132 drives the conveyance motor 121 such that a rotational force is applied to the belt roller 7 in the same direction (clockwise in FIG. 9) as the direction at the time of conveyance of the sheet P. In this instance, since the conveyor belt 8 is being attracted by the attraction platen 22, the conveyor belt 8 does not run or move in the conveyance direction, so that there is generated, at the partial region 8*c* of the conveyor belt 8, tension larger than that generated at the other region. In this state, the second cleaning sequence execution portion 132 controls the motor 59M such that the second wiping operation is similarly conducted. Subsequently, at timing when the sub wiper 51 reaches the other end of the plate 58 in the main scanning direction, the second cleaning sequence execution portion 132 stops driving of the conveyance motor 121 and the motor 59M and controls the power source 36 to stop the voltage application to the electrodes 33, 34. Thereafter, the second cleaning sequence execution portion 132 drives the motor 59M in the backward direction and stops driving of the motor 59M at timing when the sub wiper 51 reaches the home position. In this way, the second wiping operation is ended.

In the second modified embodiment described above, the tension at the partial region 8*c* of the conveyor belt 8 is larger than that at the other region, in the second wiping operation. That is, the wiping region of the conveyor belt 8 does not suffer from sagging, so as to avoid an excessive increase of a frictional force between the sub wiper 51 and the conveyor belt 8 at the wiping region. Accordingly, the conveyor belt 8 is effectively restrained from being moved or shifted in the second wiping operation.

While the preferred embodiment and the modified embodiments of the invention have been described by reference to the accompanying drawings, it is to be understood that the invention is not limited to the details of the embodiments, but may be embodied with various changes and modifications, which may occur to those skilled in the art, without departing from the scope of the invention defined in the attached claims.

The printer according to the illustrated embodiments employ the attraction portion to conduct electrostatic attraction and the attraction portion to conduct pneumatic attraction. In place of the attraction portions, there may be employed, only when the second wiping operation is conducted, a retainer for giving a retaining force for preventing the movement of the conveyor belt in the moving direction of the sub wiper 51. In this instance, the retainer may be constituted by a guide member and a moving mechanism for moving the guide member, and the controller 1*p* may be configured to control the moving mechanism such that the guide member comes into contact with opposite side ends of the conveyor belt 8 (or one side end of the conveyor belt 8 remote from the home position of the sub wiper 51), only when the second wiping operation is conducted. According to the arrangement, the retaining force is given to the conveyor belt 8. After completion of the second wiping operation, the guide member may be separated away from the conveyor belt 8. In this arrangement, the second wiping operation is conducted in a state in which the retaining force is being given to the conveyor belt 8, whereby the conveyor belt 8 is unlikely to move, ensuring the similar advantages described above with respect to the illustrated embodiments.

In the illustrated embodiments, the second wiping operation is conducted after completion of the first wiping operation. The first wiping operation may not be conducted. The main wiping mechanism 61 may not be provided. The sub wiping mechanism 62 may be juxtaposed with the main wiping mechanism 61 in the conveyance direction. The sub wiping mechanism 62 may be disposed at the position where the main wiping mechanism 61 is disposed. In other words, the sub wiping mechanism 62 may be disposed at any position as long as the sub wiper 51 can come into contact with and separate away from the surface of the conveyor belt 8.

The sub wiper 51 may extend in an intersecting direction that intersects the main scanning direction and the sub scanning direction. The sub wiper 51 may be moved in an intersecting direction that intersects the main scanning direction and the sub scanning direction in the second wiping operation.

The conveying member is not limited to the conveyor belt, but may be a rotating drum or the like. The sub wiper is not limited to the plate member, but may have any shape as long as the sub wiper can remove the foreign substances on the surface of the conveying member by a relative movement of the sub wiper and the conveying member, with the distal end of the sub wiper held in contact with the surface.

The present invention is applicable to both of the line type printer and a serial type printer. The present invention is also applicable to a facsimile machine and a copying machine, other than the printer. Further, the present invention is applicable to a recording apparatus for performing recording by ejecting a liquid other than ink. The invention is applicable to a recording apparatus of a laser type, a thermal type, and the like, other than the ink-jet type. Further, the recording medium is not limited to the sheet P, but may be various recordable medium.

What is claimed is:

1. A recording apparatus, comprising:

a recording head configured to record an image by ejecting a liquid to a recording medium;

a conveying member disposed such that a surface thereof is opposed to the recording head and configured to convey the recording medium in a conveyance direction by moving in the conveyance direction while holding the recording medium on the surface;

a conveying-member driving mechanism configured to move the conveying member;

a wiper disposed such that a distal end thereof is to come into contact with and separate away from the surface;

a wiper driving mechanism configured to drive the wiper to conduct a wiping operation in which the distal end of the wiper is brought into contact with the surface and the wiper is moved relative to the surface while being in contact with the surface in an intersecting direction that intersects the conveyance direction and that is parallel to the surface so as to wipe off foreign substances on the surface;

a retainer configured to give, to the conveying member, a retaining force for preventing a movement of the conveying member in the intersecting direction; and a controller configured to control the conveying-member driving mechanism to halt the movement of the conveying member during the wiping operation, to control the retainer to give the retaining force to the conveying member, and to control the wiper driving mechanism to conduct the wiping operation.

2. The recording apparatus according to claim 1, wherein the retainer includes an attraction portion which is disposed at a position where the conveying member is interposed between the attraction portion and the recording head, such that the attraction portion is in contact with an opposite surface of the conveying member that is opposite to the surface of the conveying member, the attraction portion being configured to generate an attraction force for attracting the recording medium to the surface while attracting the conveying member, and wherein the controller is configured to control the attraction portion so as to generate, as the retaining force, the attraction force by which the attraction portion attracts the conveying member, in the state in which the movement of the conveying member in the conveyance direction is halted.

3. The recording apparatus according to claim 2, wherein the attraction portion includes:

a base member disposed at a position where the conveying member is interposed between the base member and the recording head;

a first electrode and a second electrode disposed on a surface of the base member facing the conveying member; and a voltage applicator configured to apply a voltage between the first electrode and the second electrode so as to generate the attraction force.

4. The recording apparatus according to claim 3, further comprising an electrically conductive member disposed at a position where the conveying member is interposed between:

the electrically conductive member; and the first electrode and the second electrode.

5. The recording apparatus according to claim 3, further comprising a conveying-member driving mechanism configured to drive the conveying member such that the surface of the conveying member is moved in the conveyance direction, wherein an electrically conductive layer is formed on the surface of the conveying member so as to extend in a direction orthogonal to the conveyance direction, and wherein the controller is configured to control the conveying-member driving mechanism such that the electrically conductive layer is opposed to the first electrode and the second electrode when the wiping operation is conducted.

6. The recording apparatus according to claim 3, wherein the conveying member is a conveyor belt wound around a plurality of rollers that are disposed so as to be spaced apart from each other in the conveyance direction, the most downstream one of the plurality of rollers being located downstream of the base member, wherein the wiper is disposed so as to come into contact with and separate away from an intermediate region of the conveyor belt which is intermediate between a region of the conveyor belt facing the base member and a region of the conveyor belt where the conveyor belt contacts the most downstream one of the plurality rollers, in the conveyance direction, wherein the apparatus further comprises a conveyor-belt driving mechanism configured to drive the most downstream one of the plurality of rollers such that the surface of the conveyor belt is moved in the conveyance direction, and wherein the controller is configured to control the conveyor-belt driving mechanism so as to give, to the conveyor belt, a drive force for giving tension to the intermediate region, after the conveying member has been attracted by the attraction portion and before the wiping operation is conducted.

7. The recording apparatus according to claim 2, wherein the controller is configured to control the attraction portion such that the attraction force by the attraction portion for attracting the conveying member at a time when the wiping operation is conducted is larger than that for attracting the conveying member at a time when the recording medium is conveyed in the conveyance direction.

8. The recording apparatus according to claim 2, wherein the wiper is disposed at a position where the conveying member is interposed between the wiper and the attraction portion.

* * * * *